US005154036A

United States Patent [19]

Focke et al.

[11] Patent Number: 5,154,036

[45] Date of Patent: Oct. 13, 1992

[54] PROCESS AND APPARATUS FOR THE HANDLING, ESPECIALLY CONVEYANCE OF BLANKS

[75] Inventors: Heinz Focke, Verden; Kurt Liedtke, deceased, late of Verden, both of Fed. Rep. of Germany, by Ruth Liedtke, legal representative

[73] Assignee: Focke & Co. (GmbH & Co.), Verden, Fed. Rep. of Germany

[21] Appl. No.: 650,542

[22] Filed: Feb. 5, 1991

[30] Foreign Application Priority Data

Feb. 6, 1990 [DE] Fed. Rep. of Germany ..... 4003451

[51] Int. Cl.[5] ..... B65B 41/10; B65G 15/16

[52] U.S. Cl. ..... 53/396; 53/389.5; 198/594; 198/604; 198/607; 198/626.1; 226/172

[58] Field of Search ..... 53/389.5, 389.4, 64, 53/389.2, 396; 226/172, 189, 200, 181; 198/626.1, 607, 604, 594, 626.2, 626.3, 626.4; 493/411, 412, 415, 23, 24, 29

[56] References Cited

U.S. PATENT DOCUMENTS

| | | | |
|---|---|---|---|
| 4,054,235 | 10/1977 | Witcher | 226/200 |
| 4,350,242 | 9/1982 | Hinchcliffe et al. | 198/607 X |
| 4,509,733 | 4/1985 | Pflaum et al. | 226/189 X |
| 4,622,028 | 11/1986 | Bunch, Jr. | 493/411 X |
| 4,658,950 | 4/1987 | Itoh et al. | 198/604 X |
| 4,813,526 | 3/1989 | Bélanger | 198/588 X |
| 4,896,475 | 1/1990 | McAvinew | 493/415 X |
| 4,918,908 | 4/1990 | Focke et al. | 53/389.5 X |
| 4,940,500 | 7/1990 | Tadokoro et al. | 493/415 X |
| 4,943,271 | 7/1990 | Focke et al. | 493/24 |

FOREIGN PATENT DOCUMENTS

| | | |
|---|---|---|
| 150889 | 8/1985 | European Pat. Off. . |
| 1026271 | 3/1958 | Fed. Rep. of Germany . |
| 1574421 | 9/1979 | Fed. Rep. of Germany . |
| 3621834 | 9/1987 | Fed. Rep. of Germany . |
| 3643545 | 6/1988 | Fed. Rep. of Germany . |
| 3714483 | 7/1988 | Fed. Rep. of Germany . |
| 3716897 | 12/1988 | Fed. Rep. of Germany . |
| 3735674 | 5/1989 | Fed. Rep. of Germany . |
| 3913930 | 11/1989 | Fed. Rep. of Germany . |
| 2564065 | 11/1985 | France . |

*Primary Examiner*—Horace M. Culver
*Attorney, Agent, or Firm*—Sughrue, Mion, Zinn, Macpeak & Seas

[57] ABSTRACT

Supplying material to high-performance packaging machines is difficult, above all during the processing of blanks (20) consisting of thin cardboard for hinge-lid packs. The arrangement of the blanks (20) within a continuous material web (23), the blanks (20) being connected to one another by means of easily severable material webs (33), allows a continuous conveyance in the region of the packaging machine. For the continuous transport of the blanks (20), the material web (23) is folded in a zigzag-shaped manner to form a blank strand (24) consisting of blanks (20) lying against one another. The blank strand can be conveyed in space by being deflected in all directions. For transporting the blank strand (24) and for fixing the zigzag folding there are conveyor bands (39, 40, 41, etc) which bear against the blanks (20) in the region of longitudinal edges (21, 22) and/or transverse edges (25, 26).

16 Claims, 12 Drawing Sheets

PROCESS AND APPARATUS FOR THE HANDLING, ESPECIALLY CONVEYANCE OF BLANKS

BACKGROUND OF THE INVENTION

The invention relates to a process for the handling, especially conveyance of a plurality of blanks for the production of packs, especially in conjunction with a packaging machine. The invention relates, furthermore, to an apparatus for carrying out the process.

On high-performance packaging machines, the transport of the packaging material presents a particular problem. This is true, above all, of the processing of blanks made of thin cardboard, for example for the production of hinge-lid packs for cigarettes. In practice, the blanks especially designed for this type of pack are delivered in stacks and introduced into a magazine of the packaging machine predominately by hand. This handling involves a high outlay in terms of labour and is not in keeping with the performance of modern packaging machines.

SUMMARY OF THE INVENTION

The object on which the invention is based is to provide measures for a fault-free handling, especially transport of blanks in conjunction with a packaging machine, by means of which the use of operating personnel can be reduced to a minimum, but the blanks can nevertheless be conveyed with high efficiency even along relatively long and complex transport paths.

To achieve this object, the process according to the current invention is characterised in that a continuous material web of blanks connected to one another at their edges is folded in a concertina-like (a zigzag-shaped) manner until the blanks lie closely against one another, and in that the blank strand thus formed is conveyed via deflections of differing directions, in the region of the deflection the blanks being fanned open parallel to their folding edges or transversely relative to these.

The process according to the invention for the transport and/or storage of blanks made of thin cardboard, especially for hinge-lid packs, starts from a continuous material web of blanks which are connected to one another at their edges via material residues. In the region of these edges or residual connections, the blanks are folded in a zigzag-shaped manner, so that the blanks lie closely against one another within the material web, the composite structure being preserved, so as to form a blank strand. This is conveyed in a direction transverse relative to the plane of the blanks and is deflected with the blanks connected to one another being fanned open. The possibility of deflection is important because only in this way is it possible to obtain a conveyance which meets the requirements.

In the process according to the invention, the blank strand is also (temporarily) fanned open in the region of straight conveying zones. Segments with a differing storage capacity of blanks can thereby be formed.

The apparatus according to the invention for the handling, especially conveyance and storage of the blanks, is characterised in that the blank strand is supported and driven by driven conveying members, especially conveyor bands, at least on the inside in the region of deflections, at least on the underside in the region of horizontal conveying zones and on at least one side in the region of vertical conveying zones, the conveyor bands bearing frictionally and/or positively against the blank edges facing them, thereby taking up the blank strand.

The blanks of the material web which are folded in a zigzag-shaped manner and which predominately lie closely against one another are grasped on mutually opposite sides and transported by conveyor bands in the predominate region of a transport or storage zone. The conveyor bands are designed in a special way, namely with an elastic soft coating, into which the edges (folding edges) of the blanks are pressed slightly, with the coating thereby being deformed. This prevents the possibility of relative shifts of the blanks or of the folding edges in relation to the conveyor bands.

In the region of deflection points of the material web or of the blank strand, the blanks are fanned open in a radiating manner and thereby deflected, preferably at an angle of 90°. In the region of the deflection, the free edges of the blanks extending transversely relative to the conveying direction are supported by an outer guide and maintained at a (uniform) distance from one another. According to the invention, the support is a correspondingly deflected deflection conveyor band. On the inside, in the region of the deflection there is likewise a support for safeguarding the formation of the blank strand, specifically, depending on the particular deflection, a deflection roller for the inner conveyor band or a special shaped roller.

The blank transport according to the invention makes it possible to form blank stores in the most effective way possible. A relatively long conveying zone with blanks arranged closely next to one another affords a high storage capacity. During the reduction of the store, the blanks are (temporarily) brought to a greater distance from one another.

Especially advantageous is the design of a store in which the storage zone is variable in relation to the effective length. For this, conveyor bands for transporting the blanks are arranged adjustably in such a way that the effective conveying zone of these, namely the length of a conveying side, is variable.

Finally, the invention is concerned with imparting the zigzag arrangement to the blanks or the material web. For this, according to the invention, there is a folding member which, as a result of a to-and-fro movement, causes the material web supplied in an extended position to be folded up. The latter runs into a receiving piece which widens in a funnel-shaped manner and which is limited laterally by diverging conveyor bands. The conveying zone for the folded material web begins after the receiving piece.

Further features of the invention relate to the design of the members for conveying, deflecting and otherwise handling the blank strand, to devices for the formation and reduction of storage segments and to the formation of a zigzag-shaped folded material web from an extended position of the latter. Exemplary embodiments of the invention are explained in more detail below by means of the drawings. In these:

DESCRIPTION OF A PREFERRED EMBODIMENT

Figure 1:
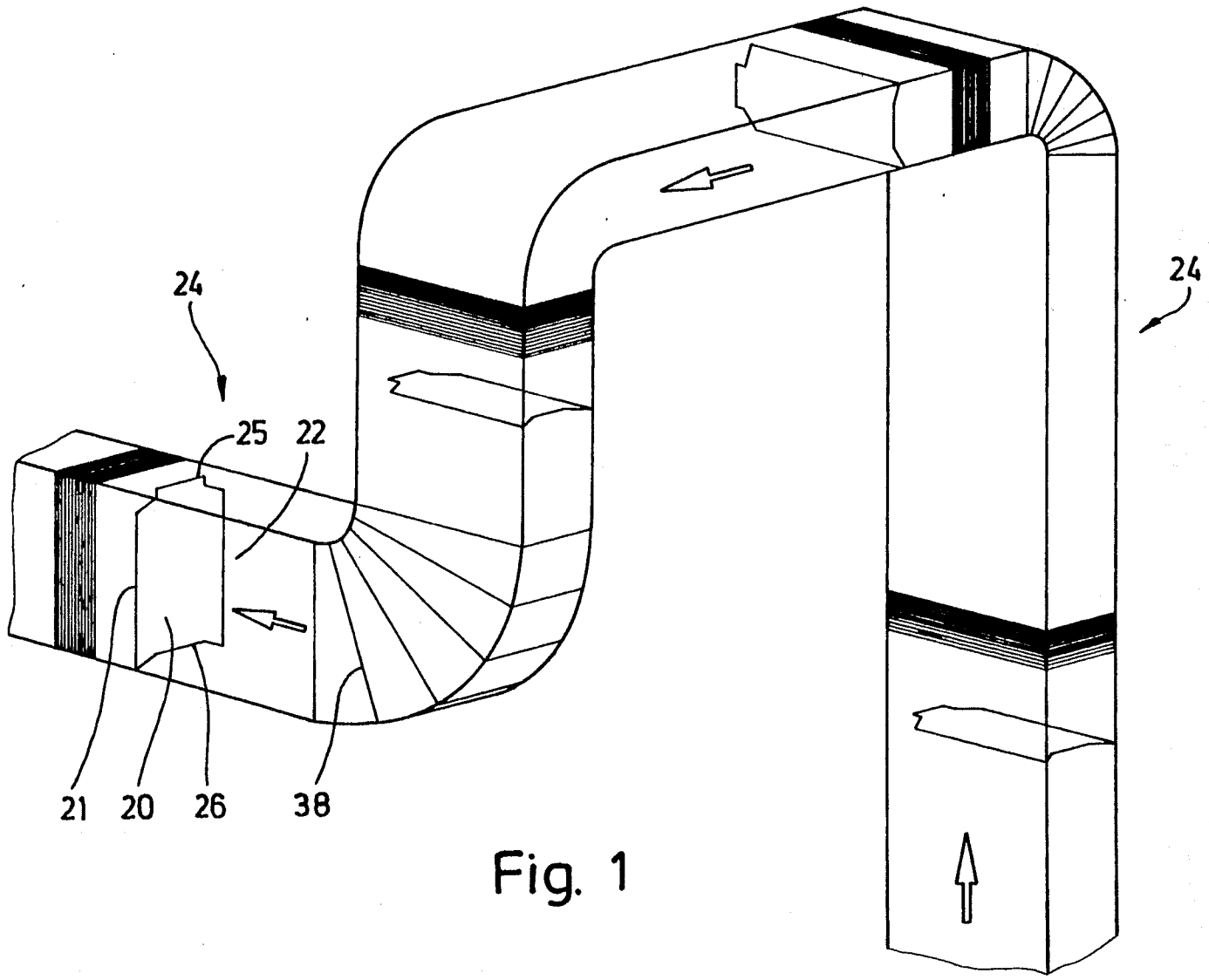
FIG. 1 shows a perspective representation of an example of the run of a blank strand with a plurality of deflections.

The apparatus, shown in detail in the drawings, for the handling, especially conveyance of blanks 20 can be in conjunction with a packaging machine (not shown), but also with a station for the loading and unloading of containers, pallets, etc. for transporting packaging material over a wide area. In the present exemplary embodiment, the blanks 20 are of a special design. They are blanks 20 for the production of hinge-lid packs, especially for receiving cigarettes. The blanks 20 used for this have a special characteristic design, as illustrated and described, for example, in DE-A-3,716,897. The blanks are connected to one another in the region of longitudinal edges 21, 22, to form a continuous material web 23.

For the transport, storage etc. of the blanks 20, the connection within the material web 23 is maintained. In the region of the longitudinal edges 21, 22, the material web 23 is folded in a zigzag-shaped manner (for example, FIG. 4, middle region. The material web 23 thus folded forms a continuous blank strand 24 consisting of blanks 20 which are fanned or which are arranged closely next to one another. As is evident especially from FIG. 1, the blank strand 24 can be deflected in all directions, the rectangular elongate blanks 20 being respectively fanned open in the transverse direction (FIG. 2) or in the longitudinal direction (FIG. 3) for the deflection of the blank strand 24.

The blanks 20 shown here have the design typical of hinge-lid packs. In the region of transverse edges 25, 26, the blanks 20 have a special form. The transverse edge 25 limits a lid inner tab 27 which extends in the middle region of the blank 20 and which, in the finished hinge-lid pack, bears against the inside of a lid front wall 28. The lid inner tab 27 forms a laterally protruding projection of the material web 23.

On the opposite side, the transverse edge 26 is directed parallel to the longitudinal axis of the material web 23 in the region of a front wall 29 of the blank 20. Obliquely directed legs 30 in the region of side tabs 31, 32 of the blank adjoin the sides.

The blanks 20 are connected to one another in the way described in DE-A-3,716,897 corresponding to U.S. Pat. No. 4,898,569 in only a part region of the longitudinal edges 21, 22 by means of material webs or residual connections 33. These extend in the region of inner side tabs 34, 35 and in the region of inner lid side tabs 36, 37 adjacent to these. In the region of the material webs 33, the material web 23 in the zigzag-shaped formation is bent around to form a folding edge 38.

Within the blank strand 24, the blanks 20 lie predominately close to one another. To stabilise the blank formation and for the preferably continuous transport of the blank strand 24, the latter is supported in the region of the folding edges 38, that is to say at the longitudinal edges 21, 22, on an endless conveyor. This consists, here, of conveyor bands 39, 40 and 41. These are designed in a special way, namely with a belt 42 which consists of a tension-resistant carrier band 43 and of an elastic soft coating 44. The latter faces the blanks 20 or the folding edges 38. These penetrate slightly into the elastic coating 44, at the same time experiencing a corresponding deformation. The blanks 20 are thereby safeguarded against a relative shift. The blank strand 24 is taken up in a slip-free manner by the conveyor bands 39, 40 and 41. The respective formation of the blanks 20 within the blank strand 24 is fixed.

The blank strand 24 is appropriately supported uninterruptedly over its entire length by conveyor bands 39, 40 and 41 or other guiding and conveying members on two sides located opposite one another. In the region of a straight conveying zone for the blank strand 24, the latter is respectively grasped by the conveying belt 42 of a conveyor band 39, 40 and 41 at the folding edges 38 extending on both sides corresponding to the longitudinal edges 21, 22. The conveyor bands appropriately extend in the middle region of the blank strand 24 or the blanks 20 (for example, FIG. 6). The conveyor bands 39, 40 and 41 have a smaller width than that of the blank strand 24. Conveyor bands can thereby be arranged offset relative to the mid-plane of the blank strand 24. It is thus possible to design the conveyor bands 39, 40 and 41 as band portions, and successive band portions can be mounted equiaxially in the deflectional region. One each of the conveyor bands 39, 40 and 40, 41 located opposite one another in the region of the blank strand 24 is driven.

Figure 6:
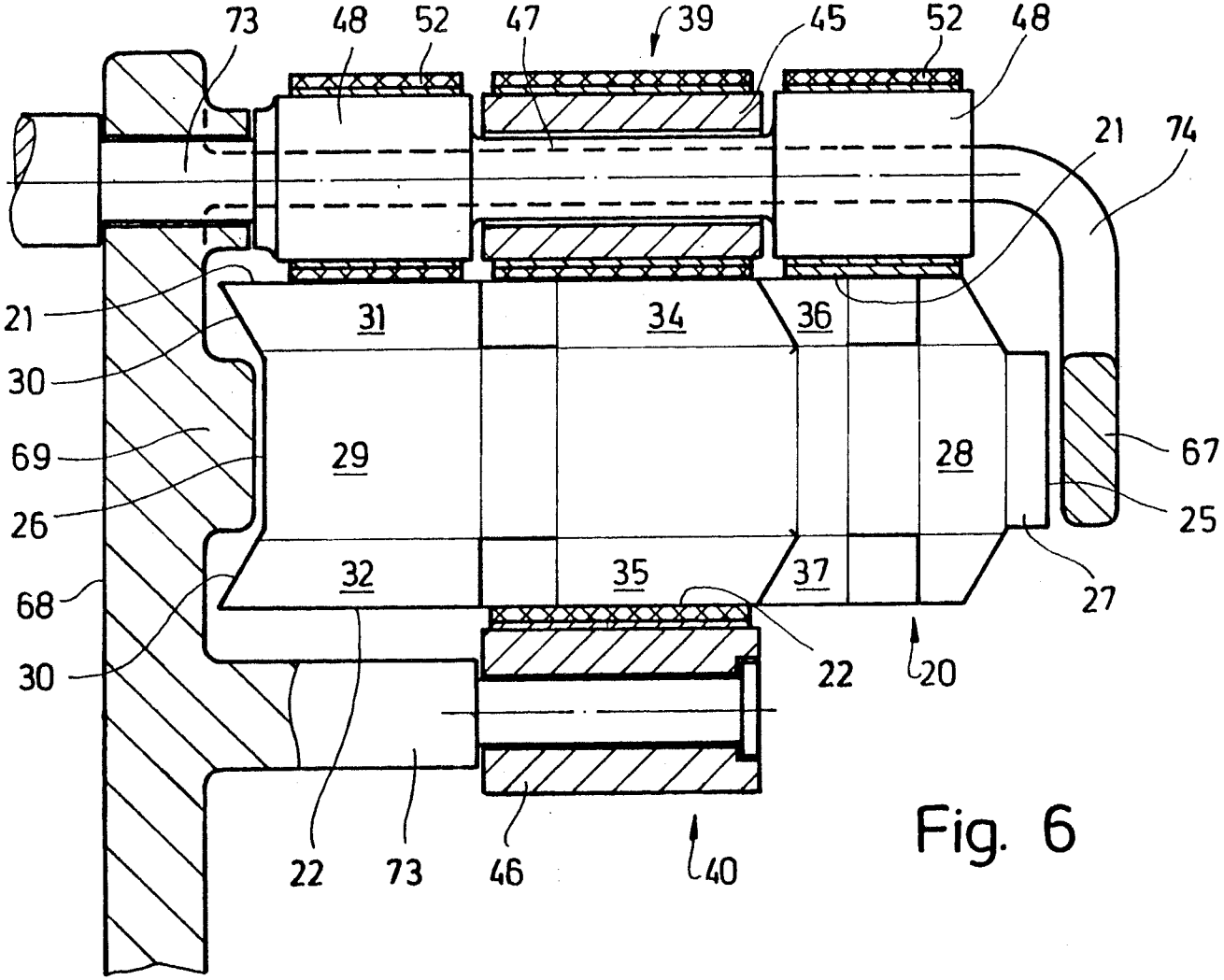
FIG. 6 shows a vertical section through a conveying region for the blanks along the sectional plane VI—VI of FIG. 2.
Figure 7:
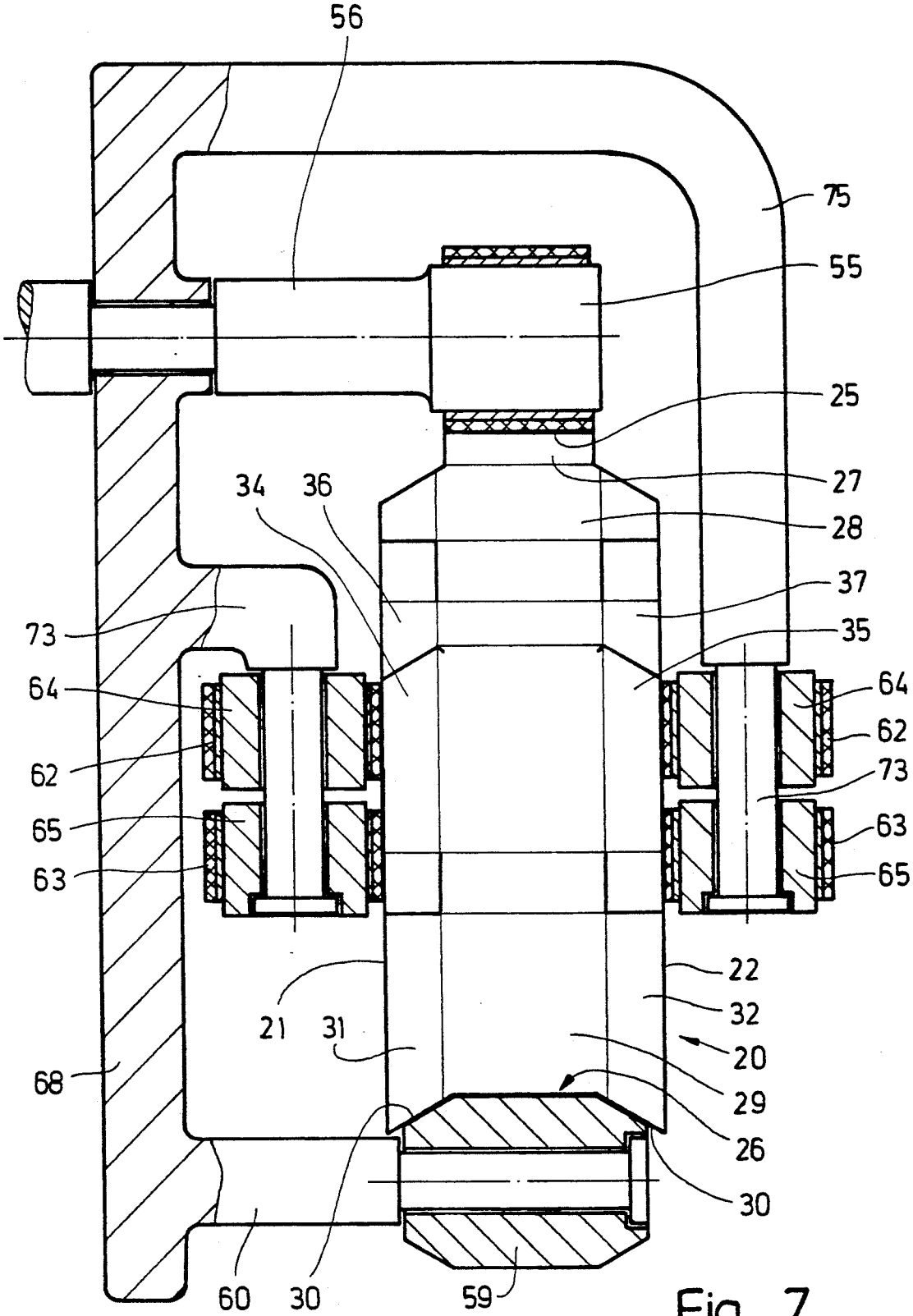
FIG. 7 shows a corresponding vertical section of the plane VII—VII of FIG. 3.
Figure 8:
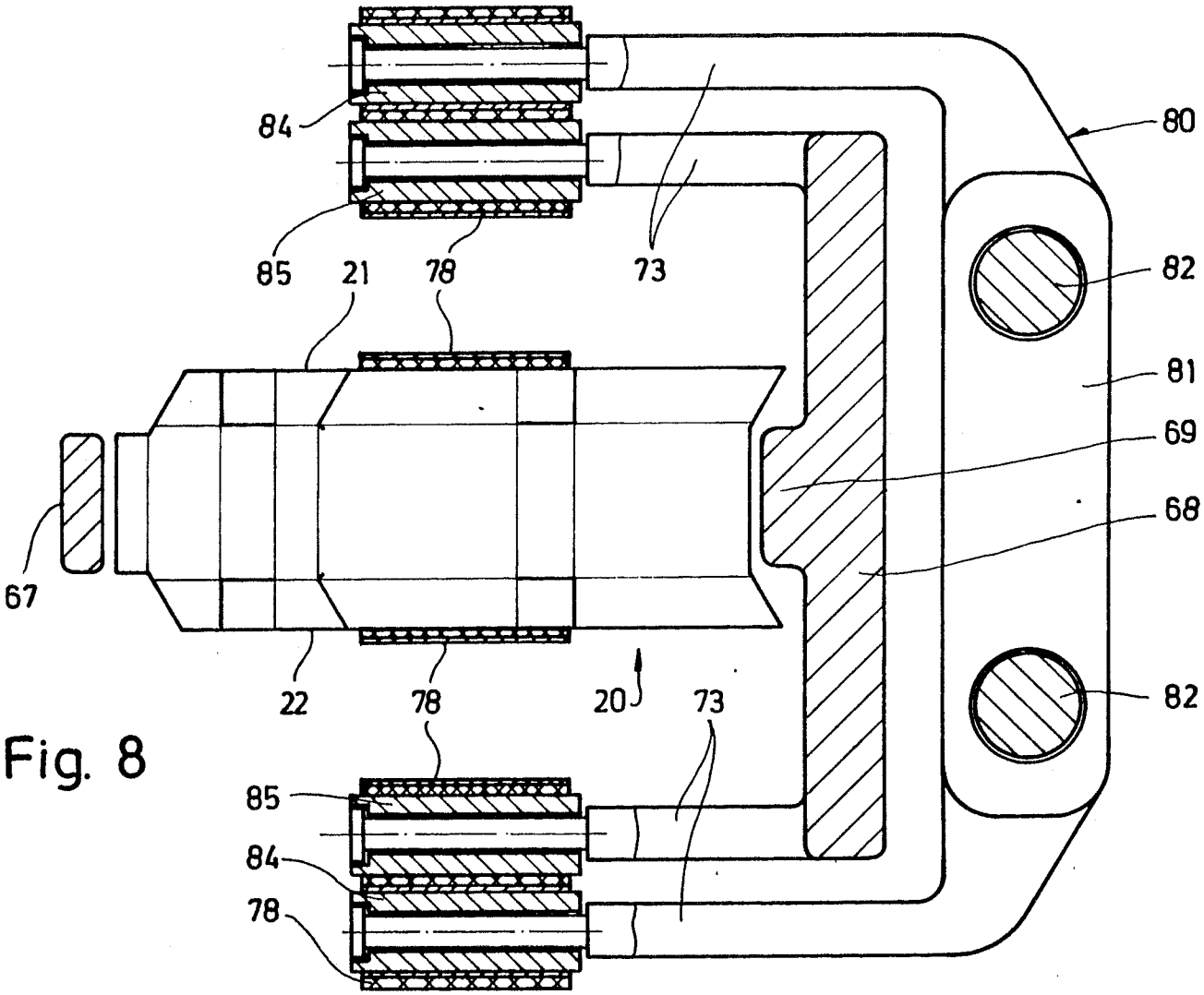
FIG. 8 shows a cross-section VIII—VIII in FIG. 4.

As is evident especially from FIG. 6, the belts 42 of the conveyor bands 39 and 40 bear against the blanks 20 in the region of the inner side tabs 34, 35. The conveyor bands 39, 40 are deflected at the start of a straight conveying zone, specifically via an outer deflection roller 45 for the upper conveyor band 39 and via an inner or lower deflection roller 46. In this version, the lower conveyor band 40 is driven, whilst the upper opposite conveyor band 39 runs freely without its own drive. For this purpose, the deflection roller 45 is mounted rotatably, specifically on a drive shaft 47 for deflection rollers 48, 49 of an adjoining portion of conveyor bands.

The design of conveying and supporting members in the region of the deflection of the material web 23 is of special importance. The deflection can take place either by means of the short dimension (width) of the blanks 20 (the exemplary embodiment of FIG. 2) or by means of the longitudinal dimension (FIG. 3). The blanks 20 are fanned open in the region of the deflection. Where the deflection by means of the shorter dimension is concerned, the folding edges 38 on the radially inner side are arranged at a shorter distance from one another and those on the radially outer side at a greater distance from one another corresponding to the greater arc length.

To bring about the last-mentioned deflection, the conveyor band 40 running on the inside is guided beyond the deflection point, and the conveying belt 42 bearing against the blank strand 24 is guided beyond the deflection roller 46 out of a horizontal conveying direction into a vertical conveying direction. The returning belt of the conveyor band 40 is guided via an appropriate deflection roller 51 arranged offset and parallel to the deflection roller 46.

In the outer region, the horizontal conveyor band 39 terminates in front of the deflection. In the vertical conveying region, the conveyor band 41 adjoins the deflection region.

So that the blank strand 24, fanned to a pronounced extent on the outside, is guided in the region of the deflection, a special deflection band 52 is provided here. This driven conveying member is designed in the same way as the conveyor bands 39, 40 and 41. As is evident from FIG. 6, there are two deflection bands 52 which run on both sides of the conveyor bands 39 and 41. The drive takes place in the region of the transition to the horizontal conveying portion (conveyor band 39). The two deflection rollers 49, 50 are mounted on a rotatably driven shaft. The deflection on the opposite side takes place in a similar way via (idling) deflection rollers 53.

The deflection bands 52 are of such a design and dimensions that the conveying belt 42 follows the arcuate contour of the blank strand 24 in the region of the deflection. As a result of the above-described design of the belt 42, the regular fan formation of the blanks 20 within the blank strand 24 is also fixed here. The fan formation occurs automatically at the transition of the material web 23 into the arc. For this purpose, the deflection band 52 or its conveying belt is driven at a higher speed than those of the conveyor bands 39, 40 and 41.

The deflection, shown in FIG. 3, by means of the longer dimension of the blanks 20 is constructed in a similar way. However, horizontally and vertically conveying conveyor bands for the blank strand 24 terminate respectively at the start and at the end of the deflection region. Within this, the blanks 20 are transported by an outer deflection conveyor 54. This is driven, specifically in the present case via a deflection roller 55 facing the horizontal conveying region. This is arranged on a driven shaft 56. An opposite deflection roller 57 facing the vertically conveying region runs idly without a drive. The deflection conveyor 54 or its conveying belt 42 bears arcuately against the outer edges of the blank strand 24, namely on the transverse edges 25 which are at the same time the free boundary edges of the lid inner tab 27. The deflection conveyor 54 has the width of the lid inner tab 27 here.

An outer return side of the deflection conveyor 54 is guided via supporting rollers 58.

Figure 2:
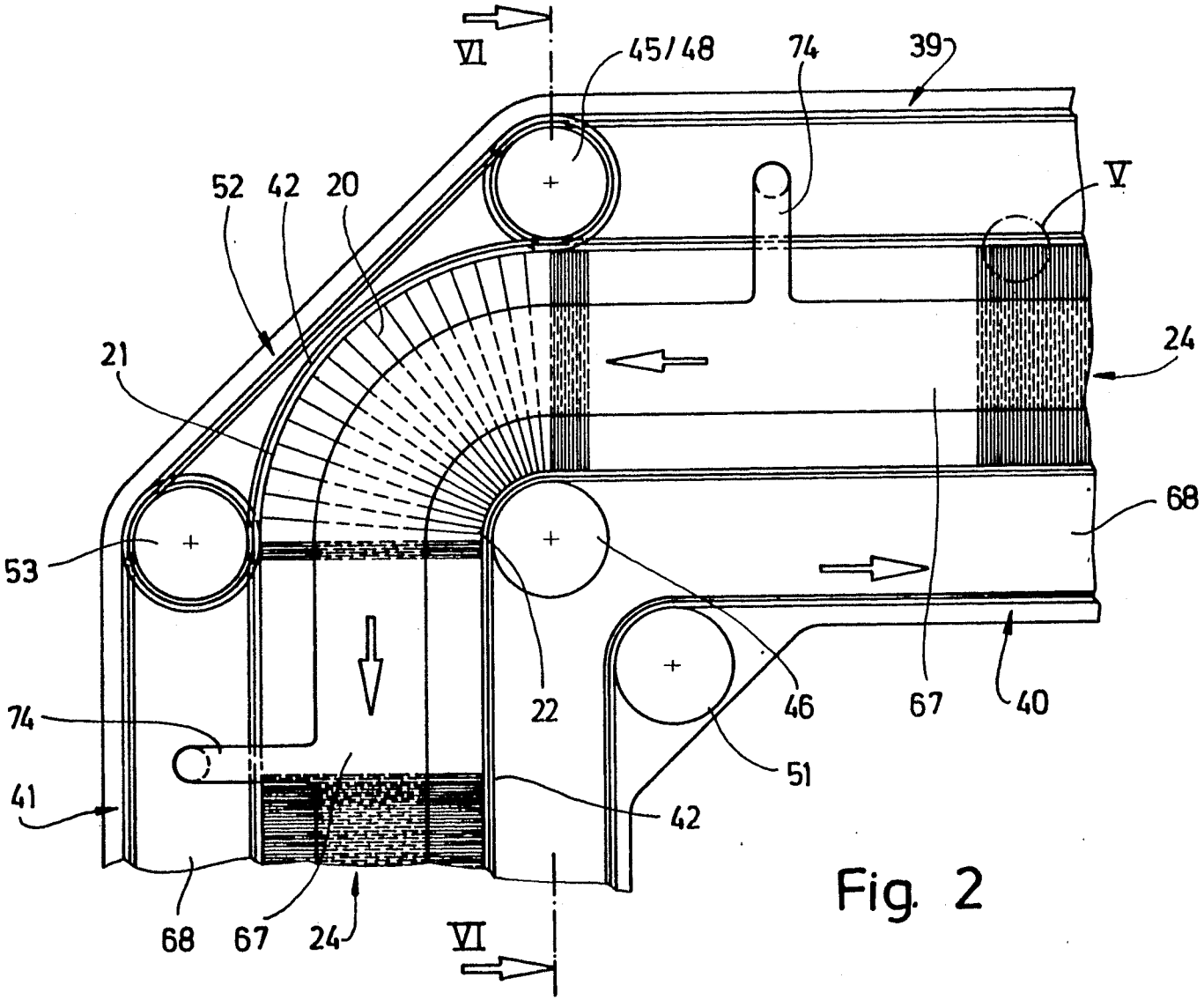
FIG. 2 shows a side view of a portion of an apparatus for conveying and deflecting a blank strand consisting of a material web folded in a zigzag-shaped manner.
Figure 3:
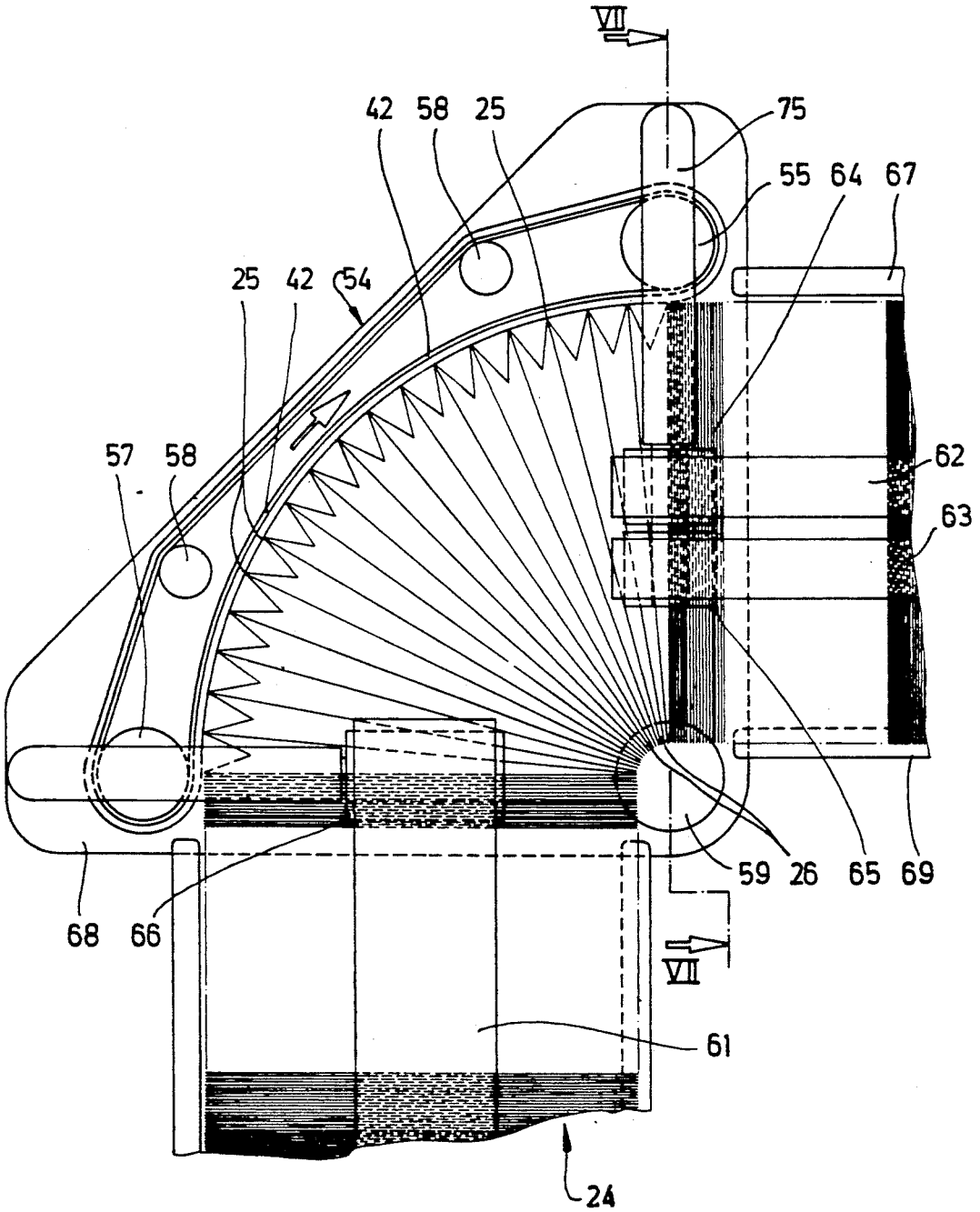
FIG. 3, shows a representation corresponding to that of FIG. 2 with a deflection in another direction.

Because of the greater arc length, the driving speed of the deflection conveyor 54 is higher than the speed of the deflection band 52 in the deflection according to FIG. 2.

On the inside, the blank strand 24 is fanned only slightly in the deflection according to FIG. 3. For the support and deflection of the blank strand 24, there is here only a freely rotatably mounted, that is to say idling, shaping roller 59. This is mounted rotatably on a carrier bolt 60. The contour of the shaping roller 59 corresponds to the contour of the transverse edge 26 with the angled legs 30. The blanks 20 are therefore supported positively on the shaping roller 59.

In the horizontal and vertical conveying regions adjacent to the deflection point according to FIG. 3, conveying members for the blank strand 24 are arranged in the region of the longitudinal edges 21, 22. The vertical conveying zone is assigned a wider conveyor band 61 here. The horizontal conveying zone has two conveyor bands 62, 63 arranged at a short distance from one another and located on both sides of the blank strand 24. These are guided via separate deflection rollers 64, 65 mounted on the same axis. The individual conveyor band 61 runs over a deflection roller 66.

The blank strand 24 is guided and protected by guiding members in the region of the free transverse edges 25, 26 not connected to one another. In the region of the transverse edge 25, that is to say of the lid inner tab 27, a guide web 67 is arranged at a short distance from the blank strand 24. Located on the opposite side is a cheek 68 of a machine frame. This forms a projecting guide rib 69 in the region of the recess formed by the transverse edge 26. Here, the projecting acute-angled corners formed by the legs 30 are located in a protected region by virtue of recesses in the cheek 68 on both sides of the guide rib 69.

Figure 9:
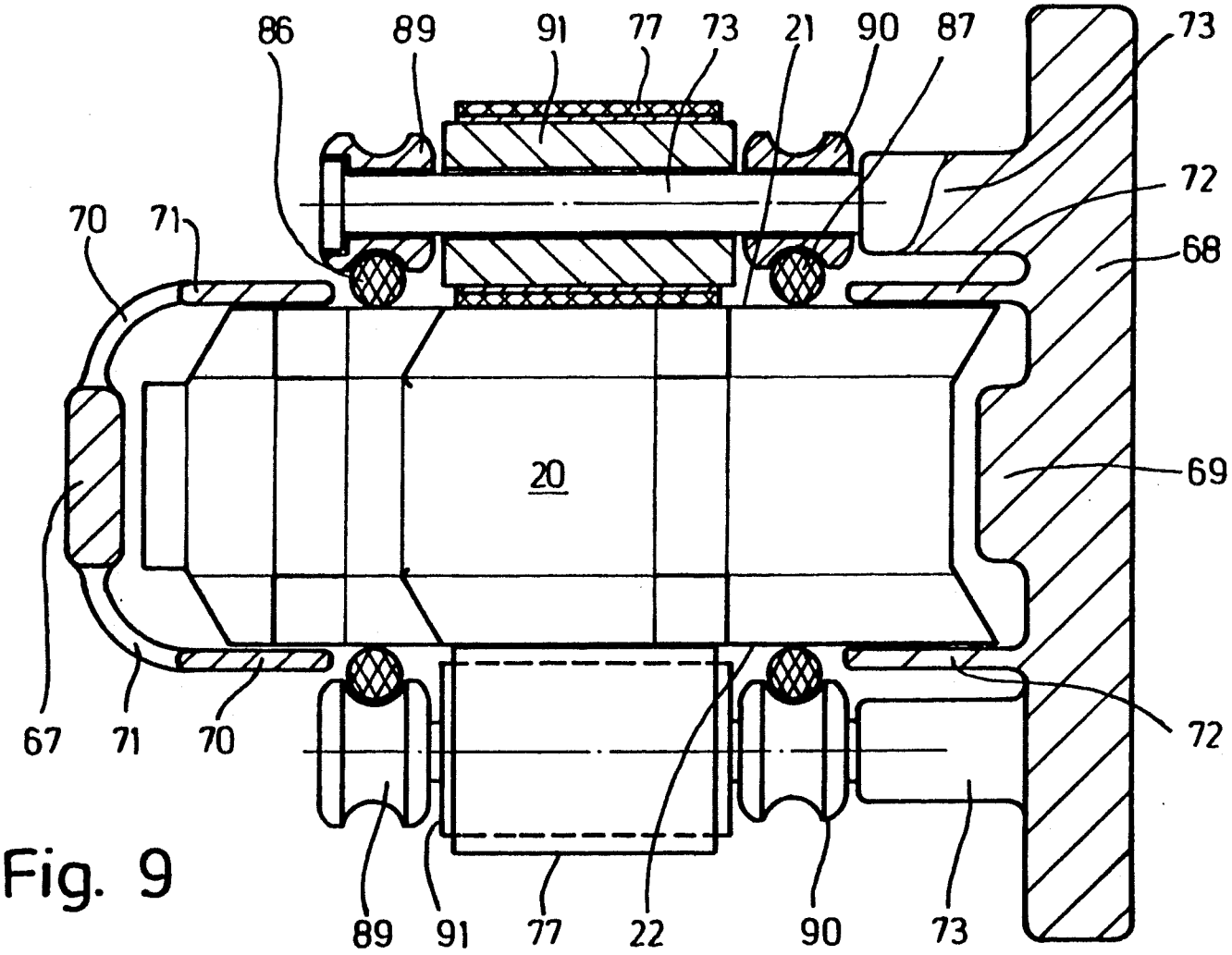
FIG. 9 shows a cross-section IX—IX in FIG. 4.
Figure 10:
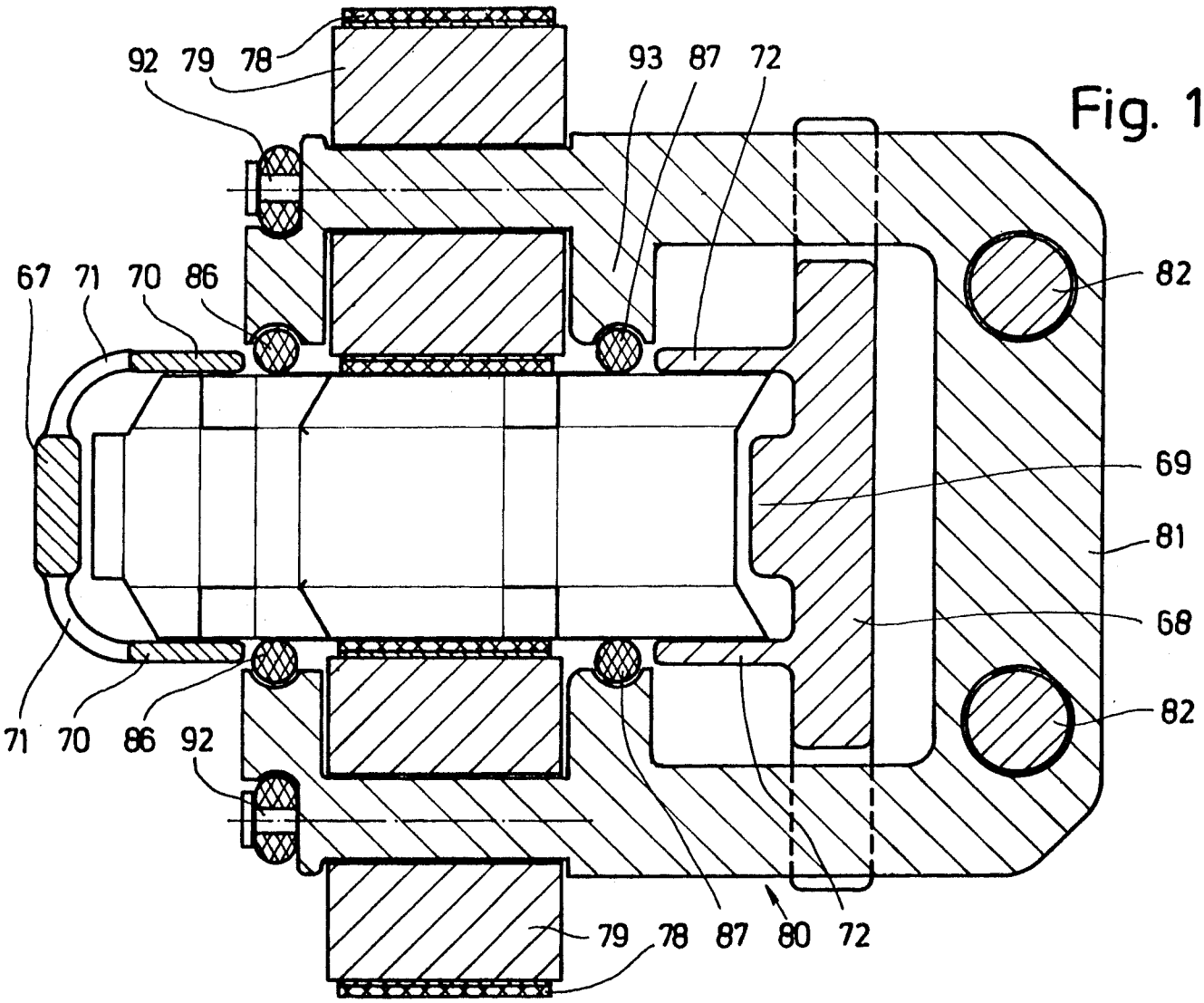
FIG. 10 shows a cross-section X—X in FIG. 4.

Additional guide members for the blank strand 24 can be arranged in the region of special conveying zones, as shown by way of example in FIGS. 9 and 10. In the region of portions of the longitudinal edges 21 and 22 adjoining the transverse edges 25, guide rails 70 are arranged on both sides of the blank strand 24 and connected to the guide webs 67 via a supporting bar 71.

The opposite region of the blank strand 24 also has corresponding guide members, namely lead webs 72 in the region of the longitudinal edges 21, 22. The lead webs 72 are connected to the cheek 68.

The cheek 68 as part of a machine frame not otherwise shown is a carrier member for the deflection rollers of the conveyor bands and of the guide webs 67. To receive the (freely rotatable) deflection rollers for the conveyor bands, freely projecting carrier bolts 73 are arranged on the cheek 68. The guide webs 67 are connected to the cheek 68 via supporting bars 74. So far as is necessary, the carrier bolts 73 can be attached to angled supporting arms 75 which are themselves connected to the cheek 68.

Figure 4:
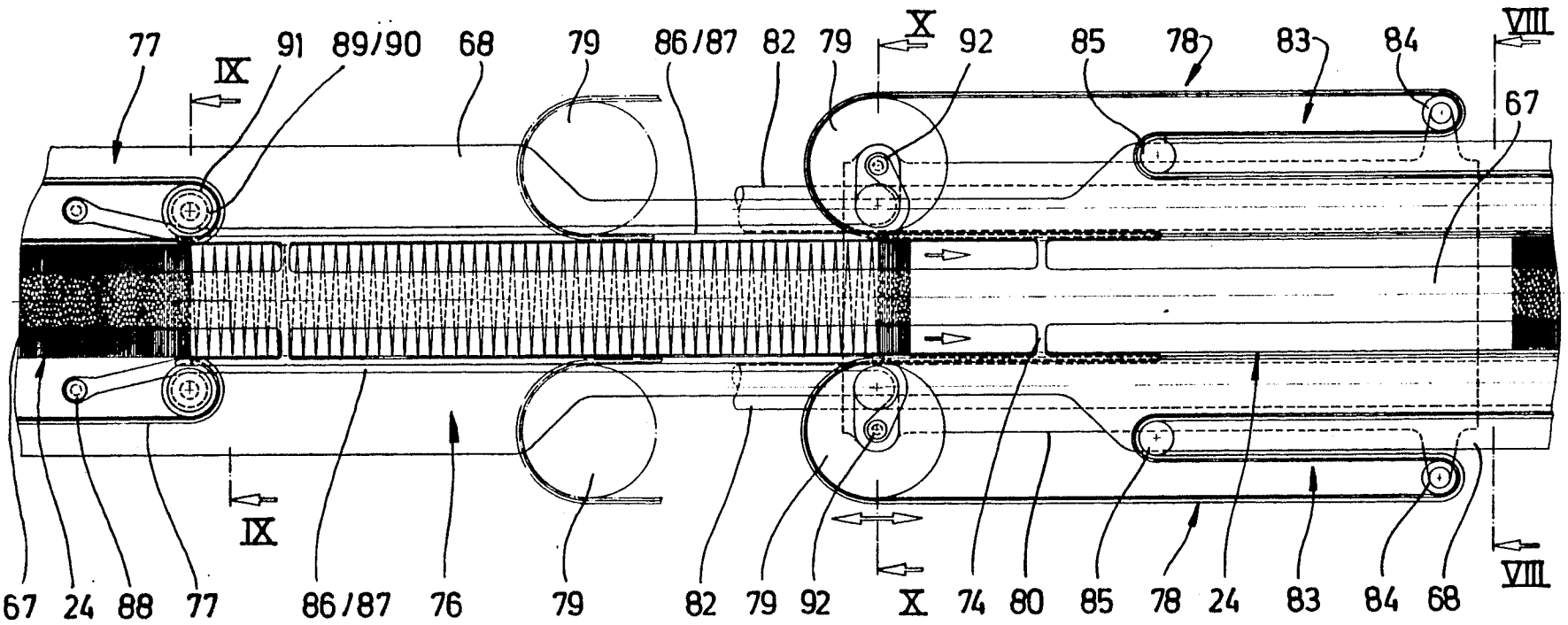
FIG. 4, shows a side view of a conveying portion of the apparatus with a variable blank store.
Figure 5:
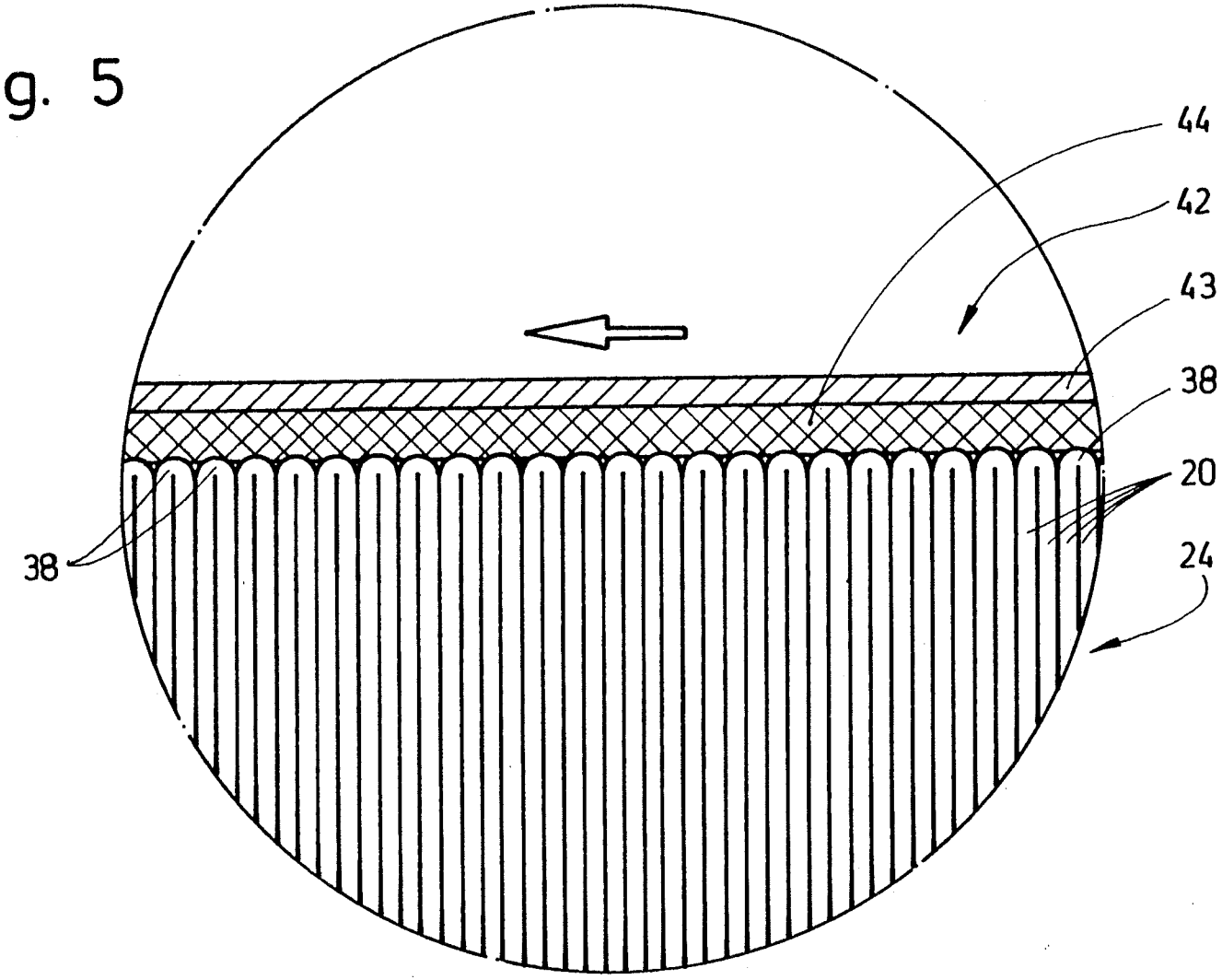
FIG. 5 shows a cutout V in FIG. 2 on a greatly enlarged scale.

The design of the blank strand 24 makes it possible to form blank stores or storage zones. These are formed in the region of horizontal or vertical conveying zones. FIG. 4 illustrates a storage zone 76 within a horizontal conveying strand. The idea behind such a storage zone is (temporarily) to fan open the close-packed arrangement of the blanks 20 within the blank strand 24, particularly for the reduction of the storage zone. During the normal transport phase, the blanks 20 are conveyed close to one another even in the region of the storage zone 76. When there is a temporarily interrupted or curtailed feed of the blank strand 24, the storage zone 76 is reduced by bringing the blanks into the fanned-open position (FIG. 4). It is thereby possible to convey blanks 20 away in a close-packed arrangement on the exit side of the storage zone 76 (on the right in FIG. 4), even when no blanks 20 are being fed on the entry side. Such an interruption of the blank feed occurs, for example, during a change of pallets or other transport members, when the blanks 20 or the material web 23 are provided in the form of a stack or as a reel.

The storage zone 76 is assigned two conveyor bands 77 and 78 working and designed independently of one another. By means of the conveyor band 77 designed in a way already described, the blank strand 24 is conveyed into the region of the storage zone 76 following the conveyor band 77. There is a relatively long distance, corresponding to the length of the storage zone 76, from the conveyor band 78 which conveys the blank strand 24 away out of the storage zone 76.

The conveyor band 78 is guided, at the end facing the storage zone 76, via deflection rollers 79 of larger size. The two deflection rollers 79 of the conveyor bands 78 located opposite one another above and below the blank strand 24 are movable to and fro in the conveying plane of the blank strand 24, in the exemplary embodiment shown in FIG. 4 out of the position represented by unbroken lines (on the right) into the position represented by dot-and-dash lines. The position represented by unbroken lines corresponds to the reduction of the storage zone 76. The store is reduced by fanning open the blanks 20 within the storage zone 76. The store now has to be built up again by supplying material (blank strand 24) by means of the conveyor band 77, until the blanks are oriented close to one another in the region of the storage zone 76. During this filling of the storage zone 76, the conveyor band 78 returns to the position represented by dot-and-dash lines as a result of the displacement of the deflection roller 79. This corresponds to the normal position.

In order to execute these movements of the conveyor band 78 for the reduction and refilling of the store, the deflection rollers 79 are mounted on a common slide 80. This is designed with a U-shaped cross-section (FIG. 10) and is displaceable on parallel sliding rods 82 by means of a (vertical) supporting wall 81. The slide 80 travels together with the deflection rollers 79 into the positions described.

To compensate the differences in length of the conveyor bands 78, these form a band loop 83 in the region of the slide 80. For this purpose, each conveyor band 78 is guided round a first loop roller 84 located on the slide 80 and a second stationary loop roller 85 located on the machine frame or on the cheek 68. During the displacement of the deflection rollers 79 into the normal position, the distance between the two loop rollers 84, 85 becomes shorter in accordance with the reduction of the band loop 83.

In the region of the storage zone 76, that is to say in a region without conveyor bands, the blank strand 24 is stabilised in the respective formation, changing in terms of the zigzag position of the blanks 20, by means of other supporting members. In the present exemplary embodiment, two elastically stretchable supporting belts 86, 87 are arranged respectively above and below the blank strand 24. These are designed here as round sections. The supporting belts 86, 87 bear at a distance from one another against the longitudinal edges 21, 22 of the blanks 20.

The supporting belts 86, 87 are anchored firmly on the entry side of the storage zone 76, in the present case to the cheek 68 by means of fastening bolts 88. The supporting belts 86, 87 run over suitably designed profiled rollers 89, 90. These are mounted here equiaxially with deflecting rollers 91 for the conveyor bands 77. The profiled rollers 89, 90 are mounted freely rotatably on a carrier bolt 73 of the deflection roller 91.

The opposite end of the supporting belts 86, 87 is connected to the slide 80, specifically likewise via a fastening bolt 92. The fastening is made here in the axis of the deflection roller 79. The supporting belts 86, 87 are guided out of the supporting plane to the fastening bolt 92 via profiled guide pieces 93 of the slide 80.

During the reduction of the storage zone 76, the supporting belts 86, 87 are stretched according to the displacement of the conveyor band 78 up to the maximum stretch according to the position in FIG. 4 represented by unbroken lines. This prevents a relative movement of the blanks 20 within the storage zone 76 in relation to the supporting members, namely the supporting belts 86, 87. The "stretching", namely spreading of the blank strand 24 takes place to the same extent as the stretching of the supporting belts 86, 87, thereby ensuring a friction-free guidance of the zigzag-shaped folded blanks 20 into the fanned-open position and back into the closely packed position.

During the reduction of the store, the conveyor band 77 is stationary or runs at a reduced conveying speed.

Figure 11:
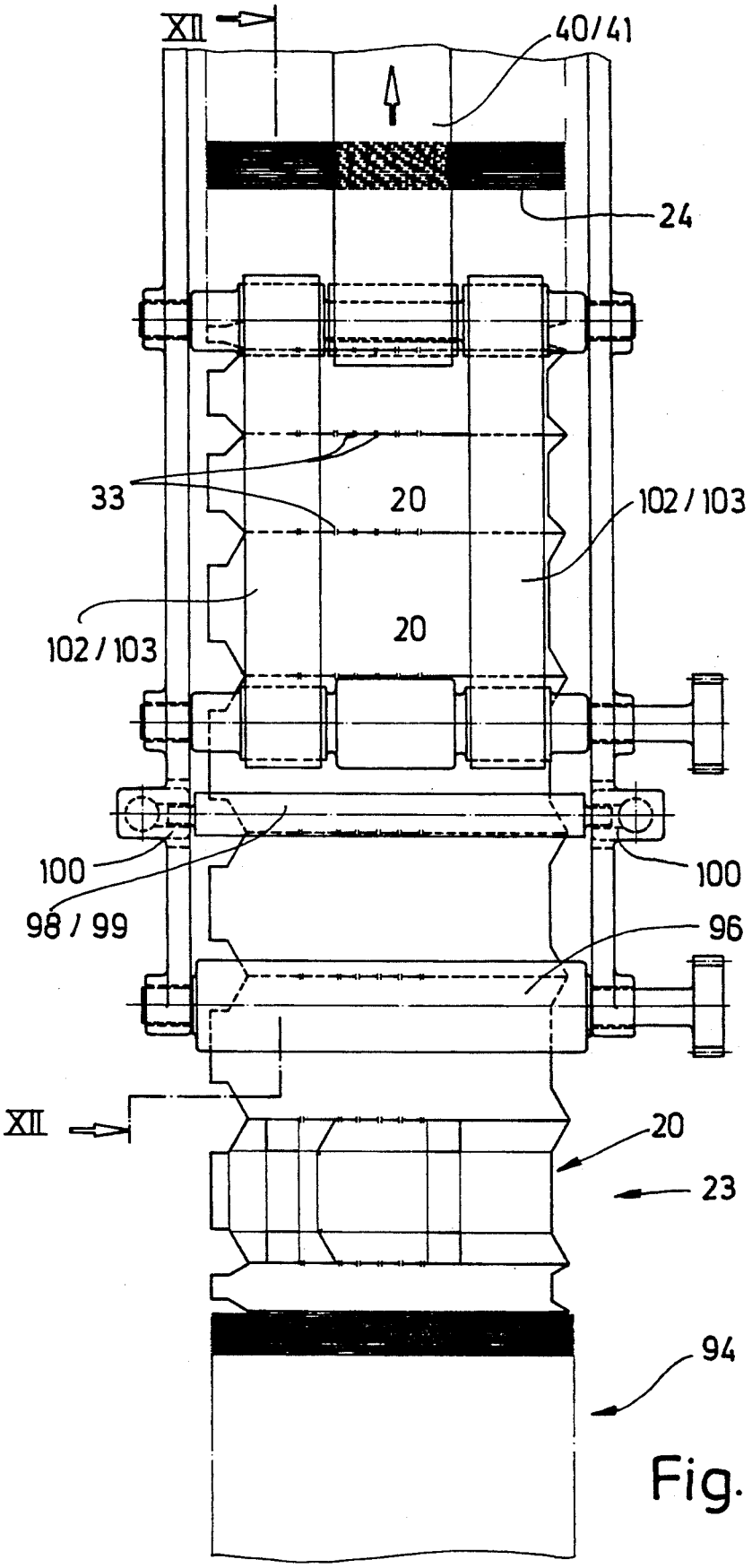
FIG. 11 shows a side view of a detail of the apparatus in the region of the reception of the material web and the production of a zigzag-shaped formation.
Figure 12:
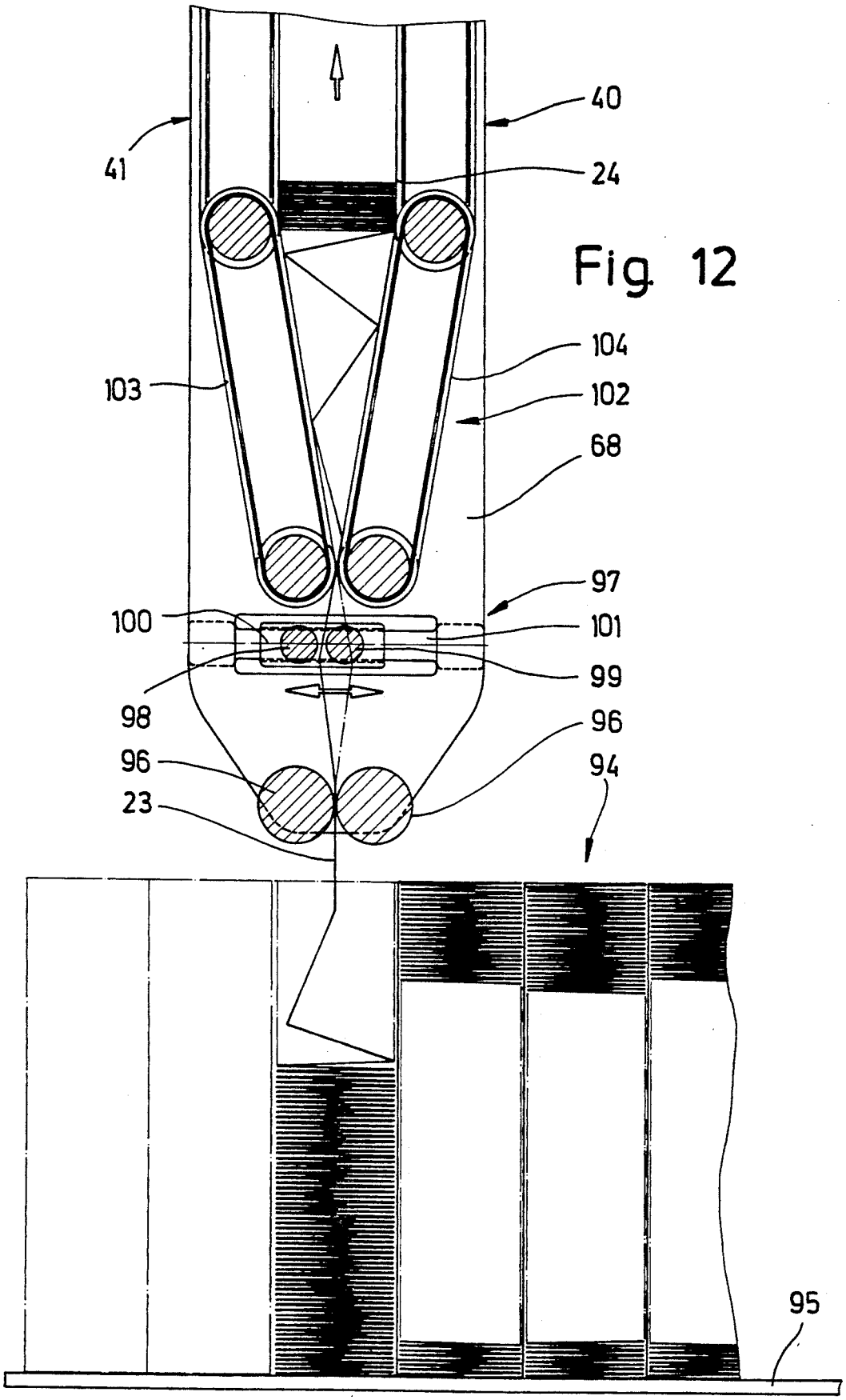
FIG. 12 shows a vertical section relating to the detail according to FIG. 11 in the sectional plane XII—XII.

Another aspect is dealt with by way of example in FIGS. 11 and 12. This is the formation of the blank strand 24 by zigzag-shaped folding of the material web 23. This can be supplied in various ways, namely as a wound reel or, as shown in FIGS. 11 and 12, in folded stacks 94 on a pallet 95 or the like. The material web 23 is drawn off successively from the stacks 24, specifically by a pair of drawing rollers 96. The material web 23 thereby temporarily assumes an extended position. There follows a folding member 97 which produces the zigzag folding (again) and which thus forms the blank strand 24, which is transported away between two (vertical) conveyor bands 40, 41.

The folding member 97 consists, here, of two folding rollers 98, 99 which are arranged at a short distance from one another and between which the material web 23 runs through. The folding rollers 98, 99 are connected to a guide element 100 which is moved to and fro in a sectional rail 101 transversely relative to the plane of the material web 23. The material web 23 runs through between the folding rollers 98, 99. A sideways movement takes place during a phase in which a bending point between adjacent blanks 20 is located in the region of the folding rollers 98, 99. The folding of the material web 23 takes place as a result of the sideways movement.

This then runs prefolded into a mouthpiece 102 diverging in the conveying direction. The latter consists of driven mouthpiece bands 103, 104 arranged on each side. With an increasing widening of a conveying space between the mouthpiece bands 103, 104, the zigzag folding is built up and the blanks 20 are moved at an increasingly shorter distance from one another, until they are finally arranged in a closely packed position in the region of the conveyor bands 40, 41.

What is claimed is:

1. Apparatus for conveying and storing blanks which are connected to one another at opposite edges thereof by residual web connections in a continuous web and which are folded in a zigzag manner until they lie closely against one another to form a blank strand, said apparatus comprising conveyor band means including conveyor bands (39, 40 and 41) for supporting and conveying the blank strand (24) along both horizontal and vertical straight conveying paths which are separated by a deflection region in which a change of conveying direction occurs;

co-running conveying means in the deflection region for supporting and transporting the blank strand (24) at edges thereof;

said co-running conveying means comprising driven conveyor belts (42) which abut outer edges (21,25) of the blank strand and transport the outer edges by frictional engagement; and means for removing said driven conveyor belts (42) faster than said conveyor band means (39,40,41) disposed in said straight conveying paths.

2. The apparatus according to claim 1, further comprising means for driving the co-running conveying means that are disposed at the inside edges (21,25) of the blank strand (24) more slowly than the driven conveyor belts abutting the outer edges (22,26) to cause the inside edges (22,26) of the blanks closely to abut one another in the deflection region.

3. Apparatus according to claim 1, further comprising a folding member (97), the blank strand (24) being formed from an extended material web (23) as a result of transverse movement of said folding member (97) which acts on the material web (23) and which exerts a transversely directed folding force in one direction and the other in a region of the folding edges (38) (21, 22) to be formed, the folding member (97) comprising two folding rollers (98, 99) which are arranged at a short distance from one another, between which the material web (23) runs through, and which are movable to and fro transversely relative to the web (23).

4. Apparatus according to claim 1, wherein the conveyor bands (39, 40 and 41) are subdivided into a plurality of bands portions directly adjacent to one another, and further comprising direction-changing rollers (49,40,51,etc), for conveyor bands adjacent to one another, which arranged on a common axis.

5. Apparatus according to claim 1, wherein, during a change of direction of the material web (23) via transverse edges (25,26) of the blanks, the blanks (20) are supported on an inside thereof on a shaping roller (59) having profile which corresponds to a contour of a transverse edge (25,26).

6. Apparatus according to claim 1, wherein the driven conveyor belts (42) are equipped with an elastic coating (44) on the conveying side facing the blanks (20), for positive or non-positive pressing in of edges of blanks (20) made of thin cardboard, 7. Apparatus according to claim 1, further comprising fixed guide means (67,69) for guiding, on free sides not frictionally engaged by the conveyor bands (39,40,41,etc) the blank strand (24) to safeguard against damage.

8. Apparatus according to claim 1, further comprising: a storage zone (76) containing a blank strand (24) of variable density of the blanks (20), said storage zone being located in a straight conveying path; and means for reducing the storage zone (76) so that the blanks (20) are fanned open at an increasing distance from one another.

9. Apparatus for conveying blanks which are connected to one another at opposite edges thereof by residual web connections in a continuous material web and which are folded in a zigzag manner until they lie closely against one another to form a blank strand, said apparatus comprising conveyor band means (39,40 and 41) for conveying the blank strand (24) along a path having both horizontal and vertical directions, said conveyor band means supporting and driving the blank strand (24) on an inside thereof in a region of a change of direction, on an underside thereof in the horizontal conveying directions, and on a lateral side thereof in the vertical conveying directions, wherein said conveyor band means comprises a plurality of conveyor bands (39, 40, 41) frictionally grasping edges (21, 22 an/or 25, 26) of the blank strand (24) which face said conveyor bands;

said apparatus further comprising: a storage zone (76) containing a blank strand (24) of variable density of the blanks (20), said storage zone being located in a region of a straight conveying zone; means for reducing the storage zone (76) so that the blanks (20) are fanned open at a increasing distance from one another; and in the storage zone (76) elastically stretchable supporting belts (86,87) which support the blank stand (24), which bear against the edges of the blank strand (24) and which follow variations in length of the storage zone (76) during the reduction and build-up of the latter by stretching, in such a way that the relative position between the edges of the blanks (20) grasped by the supporting belts (86,87) remains unchanged.

10. Apparatus for conveying blanks which are connected to one another at opposite edges thereof by residual web connections in a continuous material web and which are folded in a zigzag manner until they lie closely against one another to form a blank strand, said apparatus comprising conveyor band means (39, 40 and 41) for conveying the blank strand (24) along a path having both horizontal and vertical directions, said conveyor band means supporting and driving the blank strand (24) on an inside thereof in a region of a change of direction, on an underside thereof in the horizontal conveying directions, and on a lateral side thereof in the vertical conveying directions, wherein said conveyor band means comprises a plurality of conveyor bands (39,40,41) frictionally grasping edges (21,22 and/or 25,26) of the blank strand (24) which face said conveyor bands;

wherein said conveyor bands are co-running and continuously guide the blank strand (24) on at least two sides thereof located opposite one another;

said apparatus further comprising fixed guide means (67,69) for guiding, on the free sides not grasped by the conveyor bands (39,40,41,etc), the blank strand (24) to safeguard against damage; and wherein the conveyor bands (39,40,41,etc) for the blank strand (24) and said guide means (67,69,70,etc,) are arranged on a supporting member located on one side of said apparatus, said apparatus comprising direction-changing rollers (45,46, etc) for the conveyor bands (39, 40, 41, etc), which are attached to carrier bolts (60) and said guide means (67, etc) projecting on said one side on supporting bars (71) projecting on said one side.

11. Apparatus for conveying blanks which are connected to one another at opposite edges thereof by residual web connections in a continuous material web and which are folded in a zigzag manner until the lie closely against one another to form a blank strand, said apparatus comprising conveyor band means (39, 40 and 41) for conveying the blank strand (24) along a path having both horizontal and vertical directions, said conveyor band means supporting and driving the blank strand (24) on an inside thereof in a region of a change of direction, on an underside thereof in the horizontal conveying directions, and on a lateral side thereof in the vertical conveying directions, wherein said conveyor band means comprises a plurality of conveyor bands (39,40, 41) frictionally grasping edges (21, 22 and/or 25,26) of the blank strand (24) which face said conveyor bands;

said apparatus further comprising: a storage zone (67) containing a blank strand (24) of variable density of the blanks (20), said storage zone being located in a region of a straight conveying zone; means for reducing the storage zone (76) so that the blanks (20) are fanned open at an increasing distance from one another; and an adjustable discharge conveyor band (78) and a rear feeding conveyor band (77) between which the storage zone (76) is formed; means for deflecting said discharge and feeding conveyor bands (78 and 79) at a distance from one another, wherein the discharge conveyor band (78) is located at the front in the conveying direction of the blank strand (24); and means for moving the discharge conveyor band in the conveying direction for continuing conveyance of the blank strand (24) when there is an interrupted or reduced feed of the blank strand (24) by the rear feeding conveyor band (77).

12. Apparatus according to claim 11, further comprising: a deflection roller (79) which is movable to and fro in the conveying direction of the blank strand (24); and means for guiding the adjustable conveyor band (78) over said deflection roller (79) for building up or reducing the storage zone (76), at the same time with an increase or reduction of a band loop (83) formed by the adjustable conveyor band (78).

13. Apparatus for conveying blanks which are connected to one another at opposite edges thereof by residual web connections in a continuous material web and which are folded in a zigzag manner until they lie closely against one another to form a blank strand, said apparatus comprising conveyor band means (39, 40 and 41) for conveying the blank strand (24) along a path having both horizontal and vertical directions, said conveyor band means supporting and driving the blank strand (24) on an inside thereof in a region of a change of direction, on an underside thereof in the horizontal conveying directions, and on a lateral side thereof in the vertical conveying directions, wherein said conveyor band means comprises a plurality of conveyor bands (39,40,41) frictionally grasping edges (21,22 and/or 25,26) of the blank strand (24) which face said conveyor bands;

said apparatus further comprising a folding member (97), the blank strand (24) being formed from an extended material web (23) as a result of transverse movement of said folding member (97) which acts on the material web (23) and which exerts a transversely directed folding force in one direction and the other in a region of the folding edges (38) (21,22) to be formed, the folding member (97) comprising two folding rollers (98,99) which are arranged at a short distance from one another, between which the material web (23) runs through, and which are movable to and fro transversely relative to the web (23); and wherein the folding member (97) is followed by a mouthpiece (102) which consists of diverging mouthpiece bands (103,104) and which merges into a conveying zone, for the blank strand (24), formed by the conveyor bands (40,41).

14. A process for conveying a plurality of thin carboard packaging blanks for the production of packages in a packaging machine, said process comprising the steps of:

providing a continuous web (23) of the blanks (20) which are connected to one another at opposite edges thereof by residual web connections separated by punching cuts;

folding the blanks (20) in the web (23) against one another along respective folding edges (21,22) in a zigzag manner until they lie closely against one another, thus forming a continuous blank strand (24);

conveying the blank strand (24) along a first straight conveying path in a first conveying direction by frictionally engaging, with a first conveying drive, outer edges (21,22 and/or 25, 26) of the strand which are formed as a result of the zigzag folding step;

conveying the blank strand (24), with a second conveying drive, along a second straight conveying path in a second conveying direction, so that the blanks (20) are fanned open parallel to said respective folding edges (21,22) or transferse thereto in a deflection region of a change between said first and second conveying directions;

in the deflection region; guiding the blank strand (24) at inside edges (22,26) thereof by a deflecting means which co-runs with the blank strand; and guiding outer edges (21,25) of the blank strand (24) by a driven conveying means (42) which extends over the deflection region, which closely contacts the outer edges, and which moves faster than the first and second conveying drives disposed in the first and second straight conveying paths.

15. The process according to claim 14, wherein said conveying steps comprise conveying the blank strand in a plurality of different directions located in a plurality of planes, some of which planes are parallel to each other and some of which are perpendicular to each other.

16. The process according to claim 14, wherein the blanks (20) closely abut one another at said inside edges (22,26) in the deflection region.

* * * * *